US010807215B2

(12) United States Patent
Okada et al.

(10) Patent No.: US 10,807,215 B2
(45) Date of Patent: Oct. 20, 2020

(54) COIL SPRING PROCESSING DEVICE

(71) Applicant: NHK SPRING CO., LTD., Yokohama, Kanagawa (JP)

(72) Inventors: Hideki Okada, Yokohama (JP); Daisuke Yokota, Yokohama (JP); Senri Moriyama, Yokohama (JP); Satoshi Akiyama, Fujisawa (JP); Masaya Komazaki, Yokohama (JP); Go Nagayasu, Yokohama (JP)

(73) Assignee: NHK SPRING CO., LTD., Kanagawa (JP)

( * ) Notice: Subject to any disclaimer, the term of this patent is extended or adjusted under 35 U.S.C. 154(b) by 253 days.

(21) Appl. No.: 16/107,629

(22) Filed: Aug. 21, 2018

(65) Prior Publication Data

US 2018/0354098 A1 Dec. 13, 2018

Related U.S. Application Data

(63) Continuation of application No. PCT/JP2017/006940, filed on Feb. 23, 2017.

(30) Foreign Application Priority Data

Feb. 23, 2016 (JP) ..... 2016-032139

(51) Int. Cl.

| | |
|---|---|
| ***B24C 1/10*** | (2006.01) |
| ***B24C 3/24*** | (2006.01) |
| ***B24C 9/00*** | (2006.01) |

(52) U.S. Cl.

CPC ..... *B24C 1/10* (2013.01); *B24C 3/24* (2013.01); *B24C 9/00* (2013.01)

(58) Field of Classification Search

CPC ... C21D 7/06; B24C 1/10; B21F 35/00; B21F 35/02; B21F 23/00; B25B 1/00;

(Continued)

(56) References Cited

U.S. PATENT DOCUMENTS 2,351,726 A * 6/1944 Wallace ..... B24C 1/10 267/166
4,599,879 A * 7/1986 Lienert ..... B24C 3/083 29/90.7

(Continued)

FOREIGN PATENT DOCUMENTS

DE 4408643 C1 * 6/1995 ..... B23Q 39/046
DE 4408643 C1 6/1995

(Continued)

OTHER PUBLICATIONS

Raehder, Translation of DE-4408643-C1 (Year: 1995).*

(Continued)

*Primary Examiner* — Adam J Eiseman
*Assistant Examiner* — Bobby Yeonjin Kim
(74) *Attorney, Agent, or Firm* — Holtz, Holtz & Volek PC

(57) ABSTRACT

A coil spring processing device includes an end positioning device, shot peening device, and controller. The end positioning device positions ends of a coil spring. The shot peening device includes a turntable mechanism, pressure mechanism, rotation mechanism which rotates the coil spring, and projection mechanism which projects shots. Holding mechanisms each include a lower shifting prevention jig and an upper shifting prevention jig. The controller stops a first holding mechanism and a second holding mechanism in rotation stop positions corresponding to end turn portions of the coil spring.

6 Claims, 10 Drawing Sheets

(58) Field of Classification Search
CPC .... B25B 1/22; B25B 3/00; B25B 5/02; B25B 5/101; B25B 5/125
USPC ..... 72/53, 135, 136, 137
See application file for complete search history.

(56) References Cited

U.S. PATENT DOCUMENTS

| | | | | |
|---|---|---|---|---|
| 9,776,301 | B2 | 10/2017 | Yamamoto | |
| 2011/0053471 | A1 | 3/2011 | Jung et al. | |
| 2014/0360241 | A1 | 12/2014 | Yamamoto | |
| 2016/0208875 | A1* | 7/2016 | Yoshikawa | F16F 1/021 |
| 2017/0157744 | A1 | 6/2017 | Moriyama et al. | |
| 2017/0209982 | A1* | 7/2017 | Sugiura | B24C 1/10 |

FOREIGN PATENT DOCUMENTS

| | | | |
|---|---|---|---|
| EP | 2252434 | B1 | 9/2015 |
| JP | 56107880 | A | 8/1981 |
| JP | 2002361558 | A | 12/2002 |
| JP | 2003117830 | A | 4/2003 |
| JP | 2011247276 | A | 12/2011 |
| JP | 2015077638 | A | 4/2015 |
| WO | 2015136737 | A1 | 9/2015 |
| WO | 2016027554 | A1 | 2/2016 |

OTHER PUBLICATIONS

Extended European Search Report (EESR) dated Oct. 1, 2019 issued in European Application No. 17756615.5.
International Search Report (ISR) (and English language translation thereof) dated May 23, 2017 issued in International Application No. PCT/JP2017/006940.
Written Opinion dated May 23, 2017 issued in International Application No. PCT/JP2017/006940.

* cited by examiner

COIL SPRING PROCESSING DEVICE

CROSS-REFERENCE TO RELATED APPLICATIONS

This application is a Continuation Application of PCT Application No. PCT/JP2017/006940, filed Feb. 23, 2017 and based upon and claiming the benefit of priority from prior Japanese Patent Application No. 2016-032139, filed Feb. 23, 2016, the entire contents of all of which are incorporated herein by reference.

BACKGROUND OF THE INVENTION

1. Field of the Invention

The present invention described herein relate generally to a coil spring processing device for performing shot peening or the like to a coil spring.

2. Description of the Related Art

In order to increase durability of coil springs used in suspension springs of a suspension device of a vehicle, shot peening which imparts a compressive residual stress to the coil spring is well-known. Patent Literature 1 (JP 2002-361558 A) discloses an example of a conventional shot peening device. The shot peening device thereof projects shots to the coil spring from a centrifugal accelerator (impeller) as the coil spring is conveyed. Patent Literature 2 (JP 2003-117830 A) discloses a conventional shot peening device. The shot peening device thereof compresses the coil spring and performs shot peening while the coil spring is stressed. That is, the shot peening device of the Patent Literature performs stress shot peening to impart a greater compressive residual stress to the coil spring. Furthermore, Patent Literature 3 (JP 2015-77638 A) discloses a shot peening device which performs shot peening on a rotating turntable in a state where the coil spring is compressed.

The shot peening device as in Patent Literature 1 simply hits shots to a coil spring, and thus, there is still a chance to increase the compressive residual stress of the coil spring. The shot peening devices of Patent Literatures 2 and 3 perform shot peening while the coil spring is compressed. However, in the shot peening devices of Patent Literatures 2 and 3, when end turn portions of a coil spring have unique shapes as in those of negative pitch (negative pitch angle), the end turn portions unstably contact a holder. Thus, the coil spring with end turn portions of negative pitch may be moved during the shot peening. Thus, stress shot peening cannot be performed properly.

BRIEF SUMMARY OF THE INVENTION

Accordingly, an object of the present invention is to provide a coil spring processing device which can form a compressive residual stress effective for improving durability of coil springs.

According to an embodiment, a coil spring processing device includes an end positioning device which positions a coil spring and a shot peening device which performs shot peening while the coil spring is kept standing. The end positioning device holds the coil spring while ends of the coil spring are restricted to certain positions in a coil periphery direction. The shot peening device includes a turntable mechanism including a turntable, revolution mechanism which rotates the turntable mechanism around a revolution axis, and holding mechanism. The holding mechanism includes a lower shifting prevention jig which holds a lower end turn portion of the coil spring and an upper shifting prevention jig which holds an upper end turn portion of the coil spring, and the holding mechanism rotates around the revolution axis with the turntable. Furthermore, the coil spring processing device includes a rotation mechanism which rotates the holding mechanism around a rotation axis, a controller which stops the holding mechanism at a rotation stop position corresponding to the end turn portions of the coil spring, a transfer mechanism which sets the coil spring ends of which are restricted by the end positioning device to the holding mechanism stopped in the rotation stop position, a pressure mechanism which compresses the coil spring while the coil spring is set to the holding mechanism, and a projection mechanism which projects shots to the compressed coil spring.

According to the present invention, shot peening is performed while a coil spring is compressed (stress shot peening), a compressive residual stress which is effective to improve durability can be formed in a coil spring. Especially, a coil spring with uniquely shaped end turn portion such as end turn portion of negative pitch can be stably compressed and subjected to stress shot peening. Therefore, in the present invention, a desired compressive residual stress can be formed in a coil spring.

For example, the end positioning device includes a base, supporting member fixed to the base and supporting one end turn portion of the coil spring to rotate around an axis of the coil spring, stopper provided with the supporting member and to which one end of the coil spring contacts while the coil spring reaches a certain position around the axis, rotation member opposed to the supporting member and movable in a direction closing to and a direction apart from the supporting member while the other end turn portion of the coil spring is supported, and engaging portion provided with the rotation member and to which the other end of the coil spring contacts.

Furthermore, the shot peening device may be structured to include a first chamber and a second chamber, wherein the revolution mechanism rotates the turntable around the revolution axis 180° at a time, and the holding mechanism reciprocates over the first chamber and the second chamber by the revolution mechanism. For example the lower shifting prevention jig includes a plurality of pawls supporting the lower end turn portion of the coil spring at a plurality of positions, wherein the pawls have different heights corresponding to a pitch angle of the end turn portion.

For example, the controller stops the holding mechanism in a first rotation stop position in a state where the coil spring is before being set to the holding mechanism and stops the holding mechanism in a second rotation stop position in a state where the coil spring held by the holding mechanism is before being taken from the holding mechanism. The first rotation stop position and the second rotation stop position may differ from each other. Or, the first rotation stop position and the second rotation stop position may be the same.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, a coil spring processing device including of an embodiment will be explained with reference to FIGS. 1 to 13.

Figure 1:
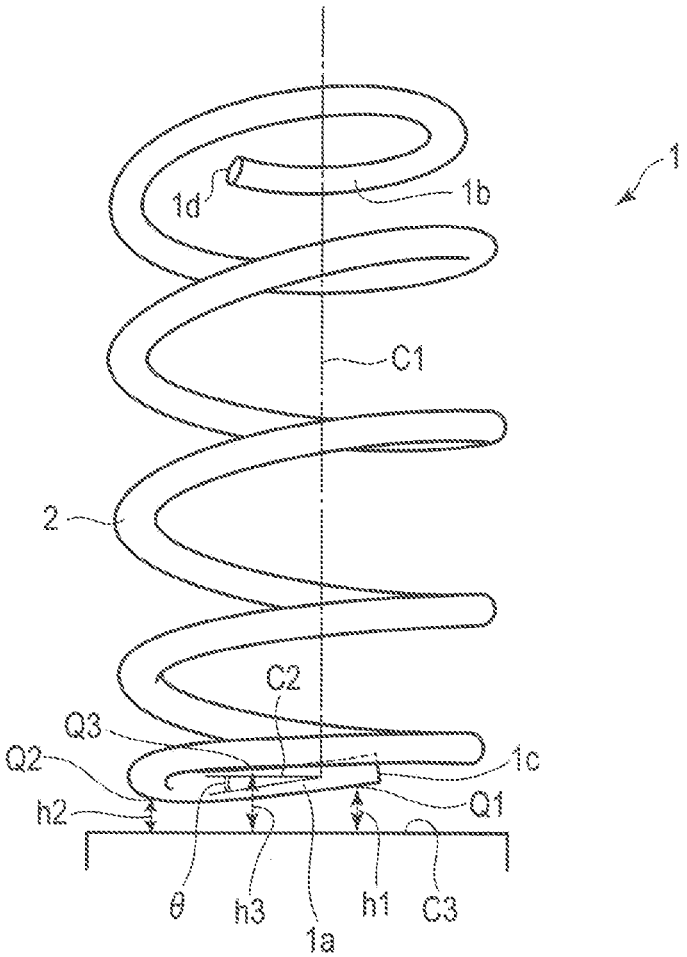
FIG. 1 is a perspective view of an example of a coil spring having end turn portions of negative pitch.

FIG. 1 shows an example of a coil spring 1 including an end turn portion 1*a* of negative pitch. The coil spring 1 is formed of an element wire 2 wound helically. An end turn portion 1*a* of negative pitch (minus pitch) has a negative pitch angle θ with respect to a line C2 orthogonal to a central axis of the coil spring 1 (axis C1). As shown in FIG. 1, when the coil spring 1 having the end turn portion 1*a* of negative pitch is set to be vertical to a horizontal surface C3, three different points Q1, Q2, and Q3 in the peripheral direction of the end turn portion 1*a* have different distances h1, h2, and h3, respectively, to the horizontal surface C3. Note that an end turn portion 1*b* in the other end of the coil spring 1 may have a negative pitch.

In the present application, a position of the coil spring 1 from the end 1*c* around an axis C1 may be referred to as a position in a peripheral direction of the coil, or as a position in a winding direction. A relative positional relationship between one end 1*c* and the other end 1*d* is constant corresponding to types of the coil spring 1. The coil spring 1 is, for example, a cylindrical coil spring; however, the coil spring 1 may be of various types such as a barrel-type coil spring, a hourglass-type coil spring, a tapered coil spring, an irregularly-pitched coil spring to conform to types of the suspension device.

Figure 2:
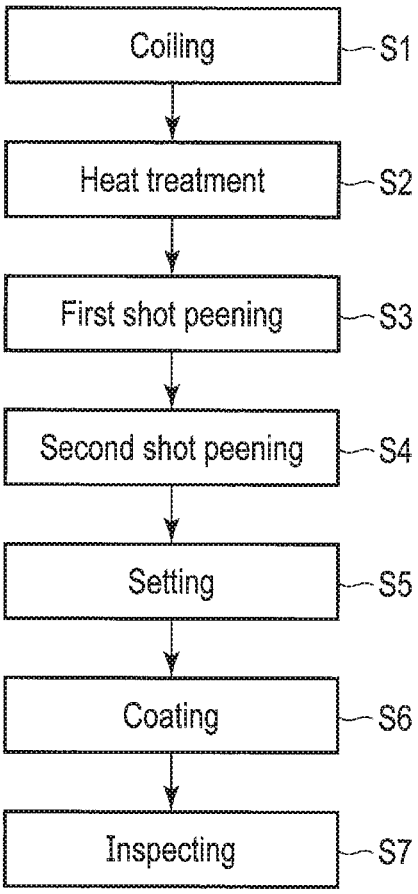
FIG. 2 is a flowchart of an example of a manufacturing process of the coil spring.

FIG. 2 shows an example of a manufacturing process of the coil spring 1. In a forming process S1 of FIG. 2, the element wire 2 is formed helically by a coiling machine. In a heat treatment process S2, tempering and annealing of the wire 2 are performed to remove a distortion stress produced in the wire 2 by the forming process S1. For example, the wire 2 is heated to 400 to 450° C. and then is cooled slowly.

Figure 3:
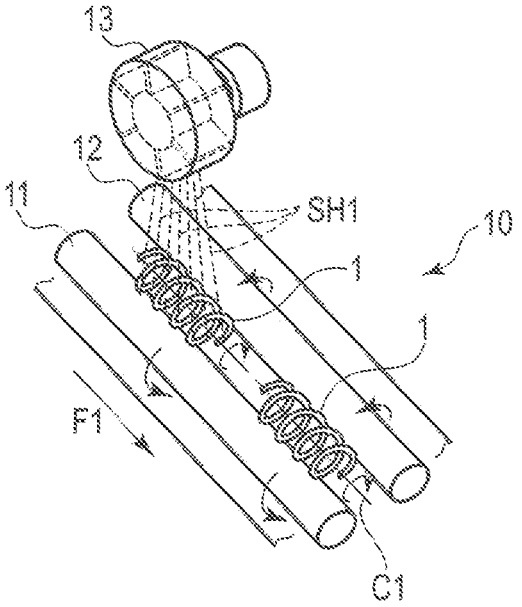
FIG. 3 is a schematic perspective view of a first shot peening device.

Furthermore, in a first shot peening process S3, first shot peening is performed in the warm using the remaining heat of the heat treatment process S2. In the first shot peening process S3, first shots are projected to the entire surface of the coil spring 1 in a process temperature of 250 to 300° C. by a first shot peening device 10 which is shown in FIG. 3. The first shot is, for example, a cut wire of which grain diameter is 1.1 mm. Note that a different shot peening device 10 may be used and a different shot size (for example, 0.87 to 1.2 mm) may be used. Through the first shot peening process S3, a compressive residual stress is produced to a relatively deep position from the surface of the coil spring 1. Furthermore, an oxide film (mill scale formed in the heat treatment) on the surface of the wire 2 is removed in the first shot peening process S3.

In a second shot peening process S4, second shot peening (warm stress shot peening) is performed by a shot peening device 50 of FIGS. 7 to 11. The second shot peening process S4 is performed in a temperature lower than that of the first shot peening process S3 (for example, 200 to 250° C.) while the coil spring 1 is compressed. In the second shot peening process S4, second shots are projected to the entire surface of the coil spring 1. The size of second shot is less than that of the first shot used in the first shot peening process S3. The second shot is, for example, a cut wire of which grain diameter is 0.4 to 0.7 mm. Through the second shot peening process S4, the absolute value of the compressive residual stress in the proximity of the surface of wire 2 can be increased.

Then, a setting process S5 is performed if necessary. Furthermore, the coil spring 1 is coated in a coating process S6, and lastly, a quality inspection is performed in an inspection process S7 and the coil spring 1 is completed.

FIG. 3 shows a schematic example of the first shot peening device 10. The first shot peening device 10 includes a pair of rollers 11 and 12 and a shot projector (impeller) 13. Coil springs 1 are disposed on the rollers 11 and 12 in series in a position where the axis C1 is horizontal (laid horizontally). The coil spring 1 on the rollers 11 and 12 is rotated around the axis C1 to continuously move in the direction of arrow F1 in the figure. The shot projector 13 projects shots SH1 to the moving coil spring 1.

Figure 4:
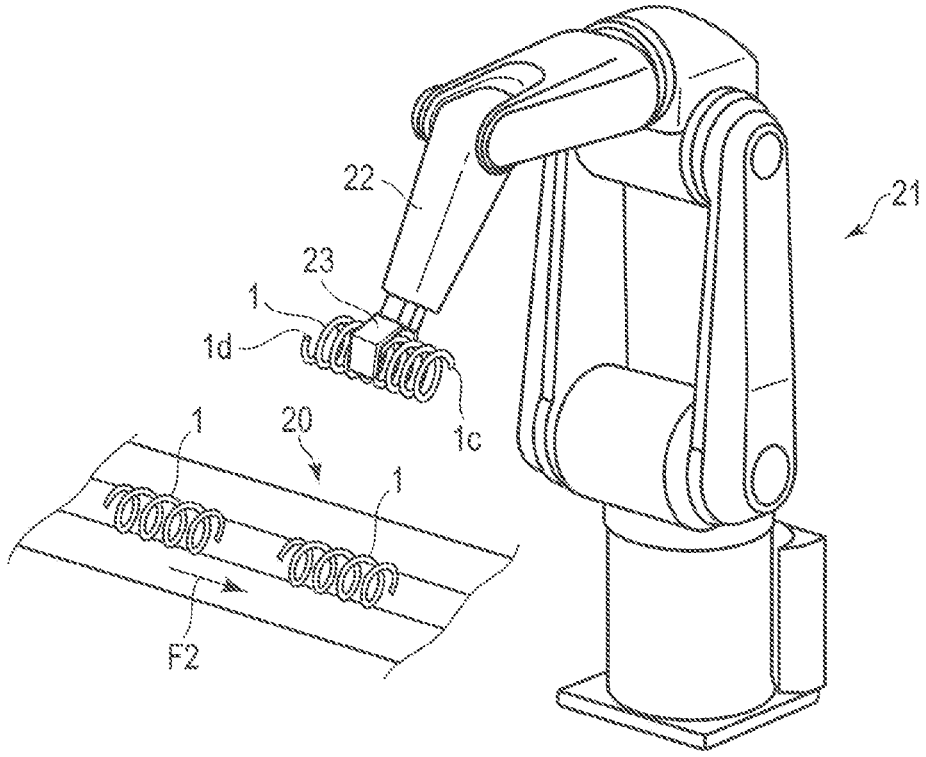
FIG. 4 is a perspective view of an example of a part of a conveyor device and a transfer mechanism (robot).

FIG. 4 shows a conveyor device 20 which is a part of the coil spring processing device and a robot 21 handling the coil spring 1. The conveyor device 20 continuously conveys the coil springs 1 in the direction of arrow F2. The robot 21 holds the coil spring 1 at both sides with an openable chuck 23 provided with the tip of an arm 22. The robot 21 is an example of a transfer mechanism used for moving the coil spring 1. The robot 21 can store the positions of the ends 1*c* and 1*d* of the coil spring 1 held by the chuck 23 in a memory.

Figure 5:
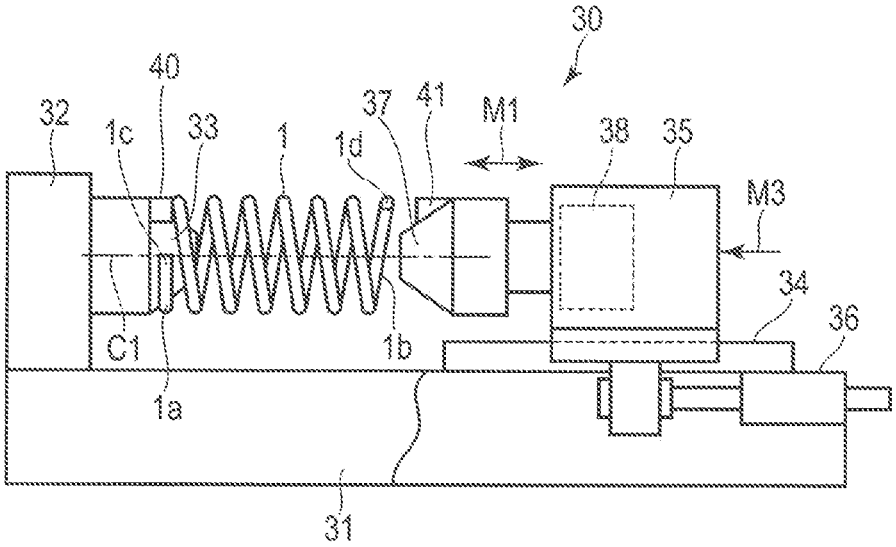
FIG. 5 is a schematic front view of an end positioning device of an embodiment.
Figure 6:
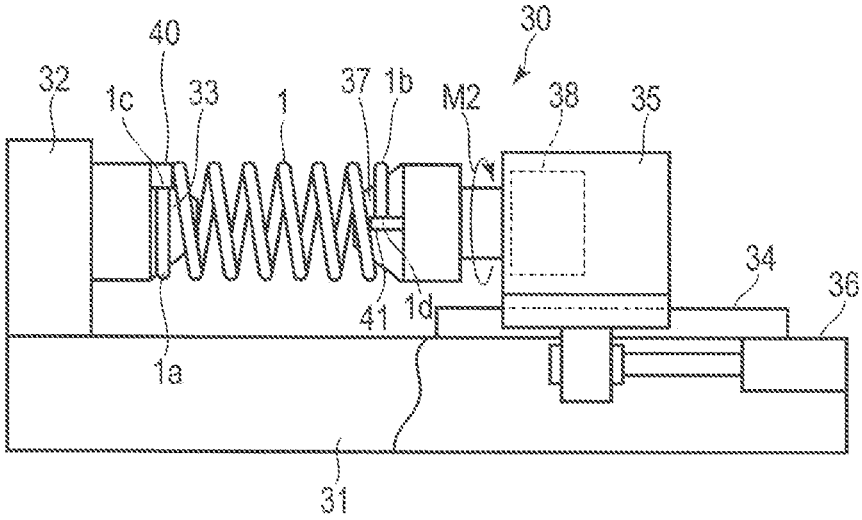
FIG. 6 is a front view showing a state where a rotation member of the end positioning device of FIG. 5 has moved.

FIGS. 5 and 6 show an end positioning device 30. The end positioning device 30 has a function to position the ends 1*c* and 1*d* of the coil spring 1 to certain positions. The end positioning device 30 is a part of the coil spring processing device. The end positioning device 30 includes a base 31, fixed side member 32, circular truncated cone-shaped supporting member 33, guide 34, movable side member 35, transfer actuator 36, circular truncated cone-shaped rotation member 37, and rotation actuator 38. The fixed side member 32 is fixed to the base 31. The supporting member 33 is attached to the fixed side member 32. The guide 34 is disposed on the base 31. The movable side member 35 linearly moves in a direction of arrow M1 (shown in FIG. 5) along the guide 34. The transfer actuator 36 moves the movable side member 35 in the direction of arrow M1. The rotation member 37 is provided with the movable side member 35. The rotation actuator 38 rotates the rotation member 37 in a direction of arrow M2 (shown in FIG. 6).

The rotation member 37 is opposed to the supporting member 33. The rotation member 37 can move between a first position shown in FIG. 5 and a second position shown in FIG. 6 by the transfer actuator 36. The rotation member 37 moves in the direction of arrow M1 (directions to be close to and apart from the supporting member 33) together with the movable side member 35.

The supporting member 33 supports the end turn portion 1*a* of the coil spring 1 to rotate around the axis C1. A stopper 40 is provided with a part of the supporting member 33 in the peripheral direction. The stopper 40 is disposed in a position where one end 1*c* of the coil spring 1 contacts. An engaging portion 41 is provided with a part of the rotation member 37 in the peripheral direction. The engaging portion 41 is disposed in a position where the other end 1*d* of the coil spring 1 contacts.

The transfer actuator 36 uses compressed air as a drive source thereof and moves the rotation member 37 toward the supporting member 33. Here, the transfer actuator 36 moves the rotation member 37 with a relatively small force (force which does not substantially compress the coil spring 1). The rotation actuator 38 uses compressed air as a drive source thereof and rotates the rotation member 37. Here, the rotation actuator 38 rotates the rotation member 37 with a relatively small torque (torque which does not substantially twist the coil spring 1).

FIG. 5 shows that the end turn portion 1*a* of the coil spring 1 contacts a conical surface of the supporting member 33. The rotation member 37 proceeds rotating in a direction of arrow M3 from the first position to the second position while the end turn portion 1*a* is contacting the supporting member 33. Thus, as shown in FIG. 6, while the conical surface of the rotation member 37 is contacting the end turn portion 1*b*, the engaging portion 41 contacts the end 1*d*. Then, the other end 1*c* contacts the stopper 40 and the rotation member 37 stops, and the positioning of the ends 1*c* and 1*d* are performed. The robot 21 (shown in FIG. 4) holds the coil spring 1 with the chuck 23. The robot 21 takes the coil spring 1 from the end positioning device 30 while recognizing the position of the end 1*c* of the coil spring 1.

Now, a second shot peening device 50 will be explained with reference to FIGS. 7 to 12. The second shot peening device 50 is a part of the coil spring processing device. The second shot peening device 50 performs shot peening while the coil spring 1 is kept standing. "The position where the coil spring 1 is kept standing" means that the axis C1 of the coil spring 1 is substantially vertical.

Figure 7:
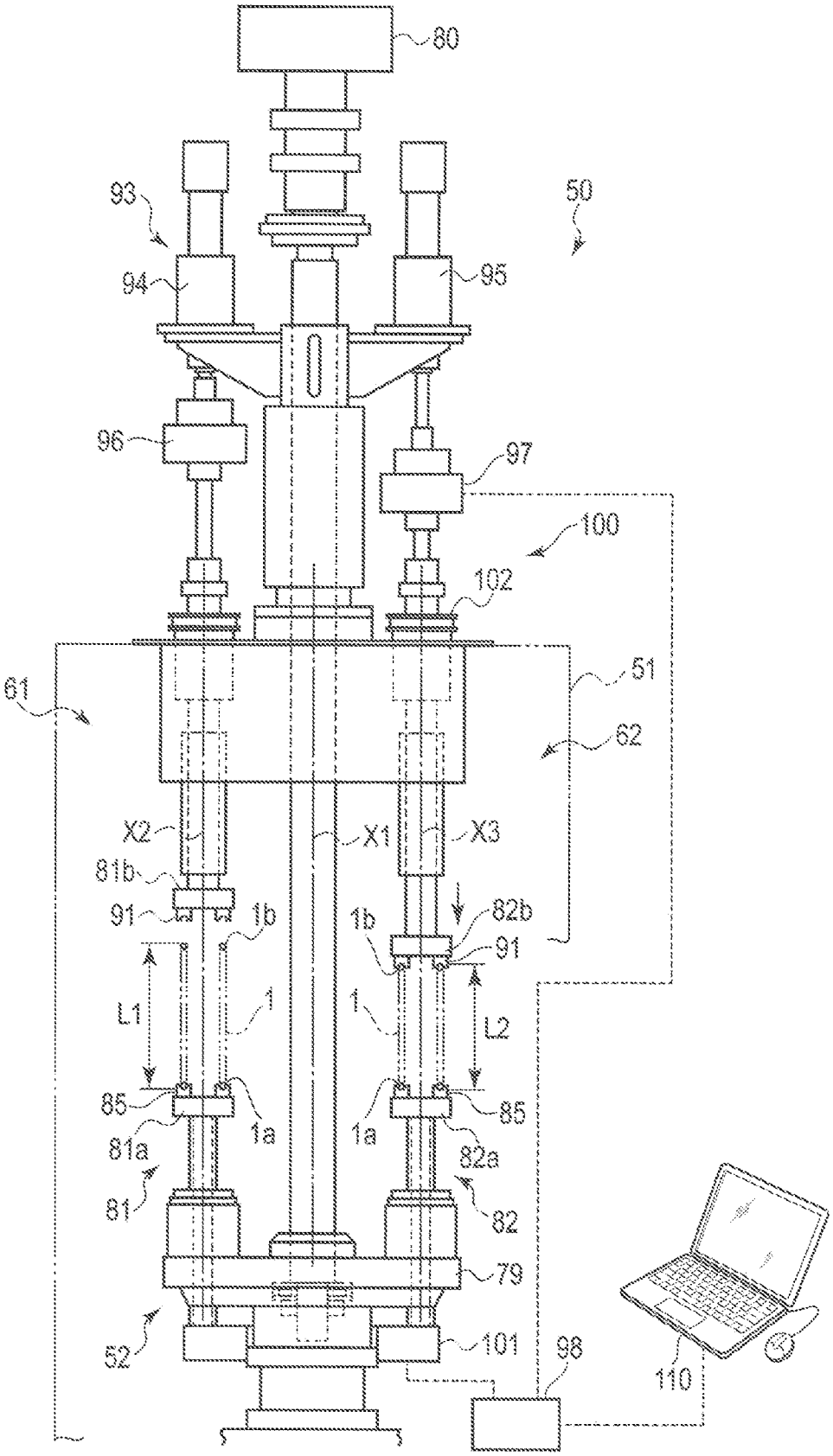
FIG. 7 is a front view showing a part of a second shot peening device of an embodiment.
Figure 8:
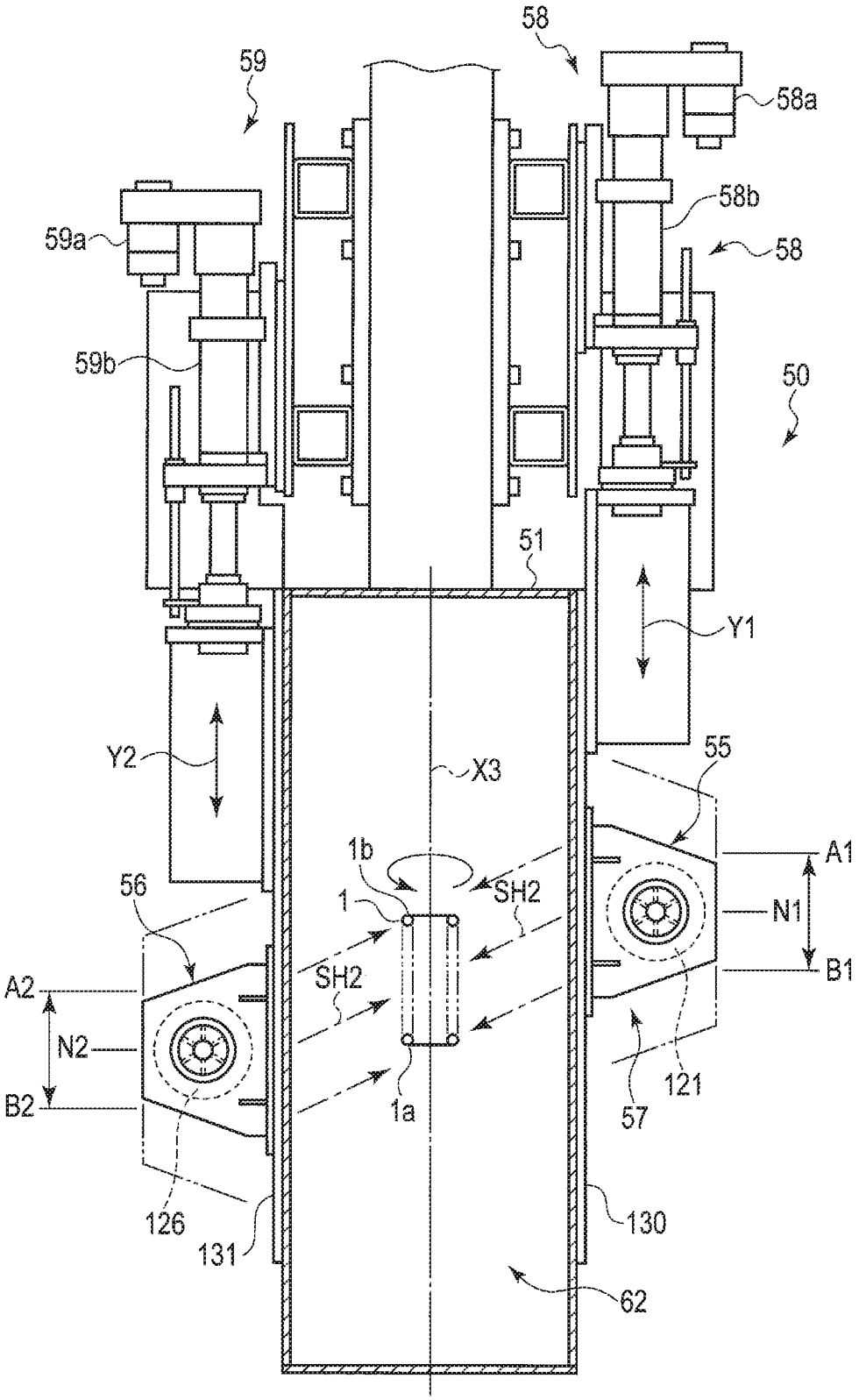
FIG. 8 is a vertical cross-sectional view of the shot peening device of FIG. 7.
Figure 9:
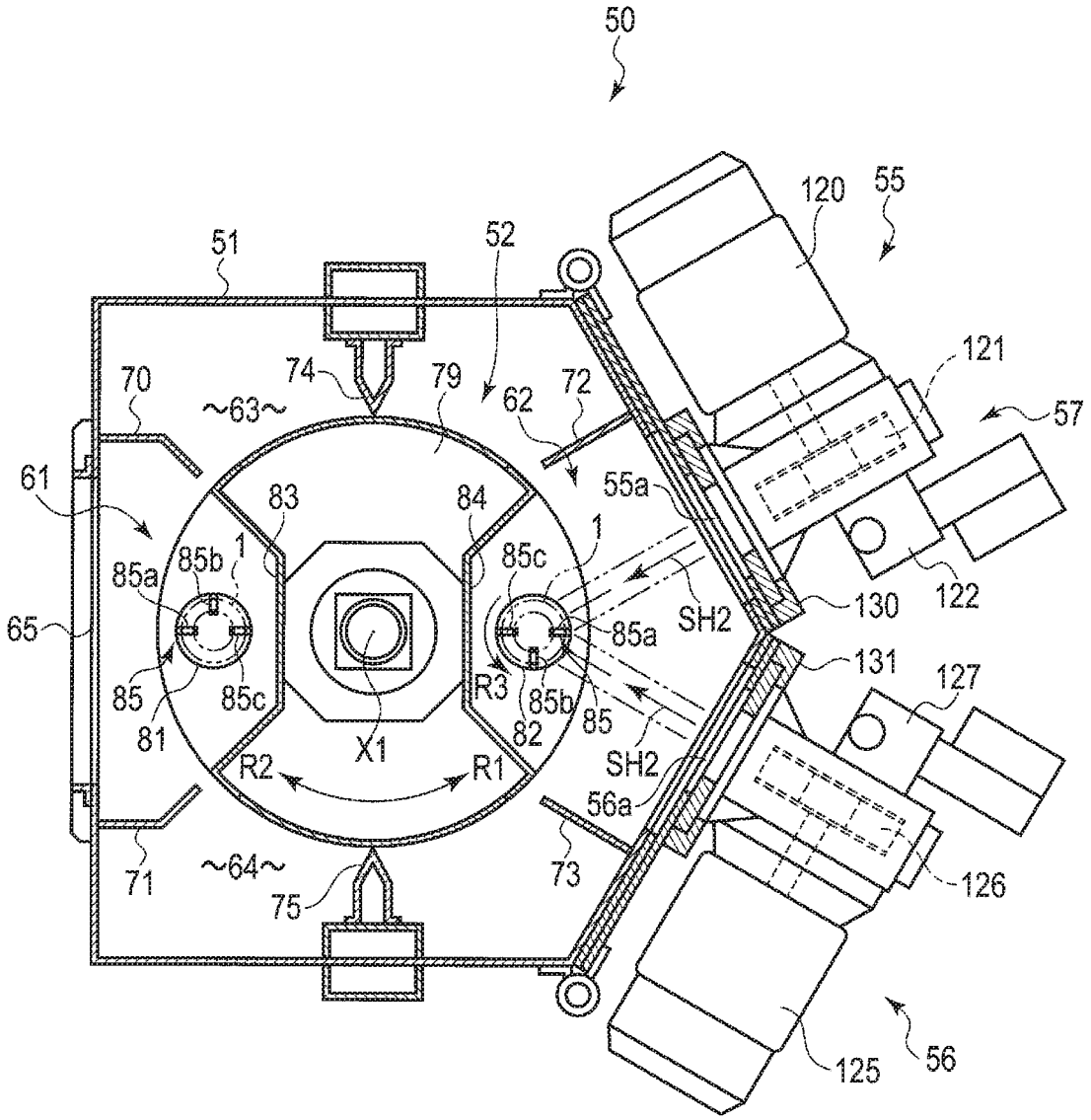
FIG. 9 is a horizontal cross-sectional view of the shot peening device of FIG. 7.

FIG. 7 is a front view showing a part of the second shot peening device 50. FIG. 8 is a vertical cross-sectional view of the second shot peening device 50. FIG. 9 is a horizontal cross-sectional view of the second shot peening device 50. The second shot peening device 50 includes a housing 51, turntable mechanism 52, projection mechanism 57 (shown in FIG. 8), first elevator mechanism 58, and second elevator mechanism 59. The projection mechanism 57 includes a first projection unit 55 and a second projection unit 56. The first elevator mechanism 58 and the second elevator mechanism 59 move the projection units 55 and 56 vertically.

The first elevator mechanism 58 and the second elevator mechanism 59 include, for example, servo motors 58*a* and 59*a* (shown in FIG. 8) of which rotation is controlled by a controller and ball screws 58*b* and 59*b*. The elevator mechanisms 58 and 59 move the projection units 55 and 56 independently and vertically at constant strokes Y1 and Y2 based on the direction and amount of rotation of the servo motors 58*a* and 59*a*.

As shown in FIGS. 8 and 9, the housing 51 includes a first chamber 61, a second chamber 62, and middle chambers 63 and 64 which are disposed between the chambers 61 and 62. A coil spring inlet/outlet port 65 is formed in the first chamber 61. The coil spring inlet/outlet port 65 is an opening through which the coil spring 1 is put in and out the first chamber 61 from the outside the housing 51. The second chamber 62 is provided with a projection port 55*a* of the first projection unit 55 and a projection port 56*a* of the second projection unit 56. Shots SH2 are projected to the coil spring 1 from the projection ports 55*a* and 56*a*.

As shown in FIG. 9, partition walls 70 and 71 are provided between the first chamber 61 and the middle chambers 63 and 64. Partition walls 72 and 73 are provided between the second chamber 62 and the middle chambers 63 and 64. Seal walls 74 and 75 are formed in the middle chambers 63 and 64. The seal walls 74 and 75 keep the shots SH2 projected in the second chamber 62 from going to the first chamber 61.

As shown in FIG. 7, the turntable mechanism 52 includes a turntable 79, revolution mechanism 80 (shown in FIG. 7), first holding mechanism 81, and second holding mechanism 82. The turntable 79 rotates around a revolution axis X1 extending in the vertical direction. The revolution mechanism 80 includes a motor which intermittently rotates the turntable 79, 180° at a time around the revolution axis X1 in either first direction R1 or second direction R2 (shown in FIG. 9). The holding mechanisms 81 and 82 rotate around the revolution axis X1 together with the turntable 79. The first holding mechanism 81 includes a lower side holder 81*a* and an upper side holder 81*b*. The lower side holder 81*a* is disposed on the turntable 79. The upper side holder 81*b* is disposed above the lower side holder 81*a* to be opposed thereto. The second holding mechanism 82 also includes a lower side holder 82*a* and an upper side holder 82*b*. The lower side holder 82*a* is disposed on the turntable 79. The upper holder 82*b* is disposed above the lower side holder 82*a* to be opposed thereto.

The first and second holding mechanism 81 and 82 are positioned 180° symmetrically about the revolution axis X1. In the rear side of the first and second holding mechanisms 81 and 82 on the turntable 79, backup plates 83 and 84 (shown in FIG. 9) are disposed.

Figure 10:
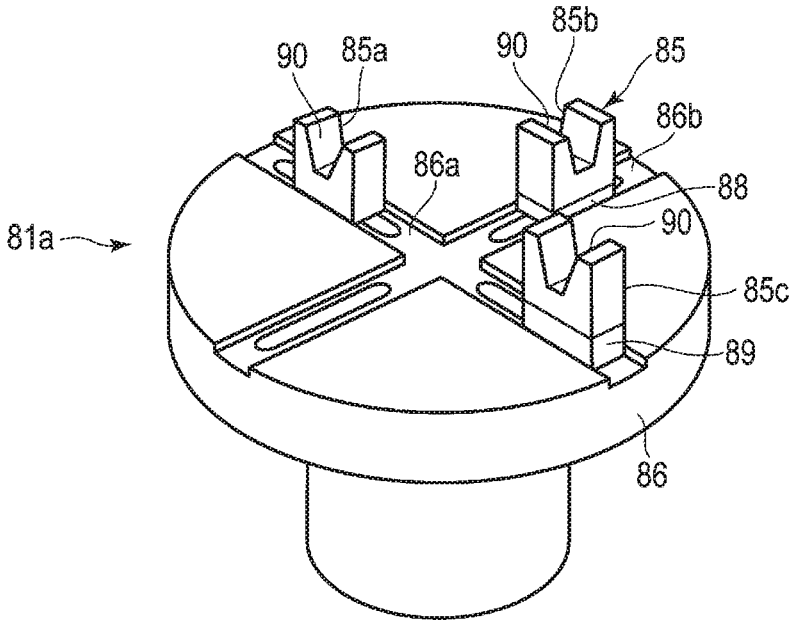
FIG. 10 is a perspective view of a lower side holder of the shot peening device of FIG. 7.
Figure 11:
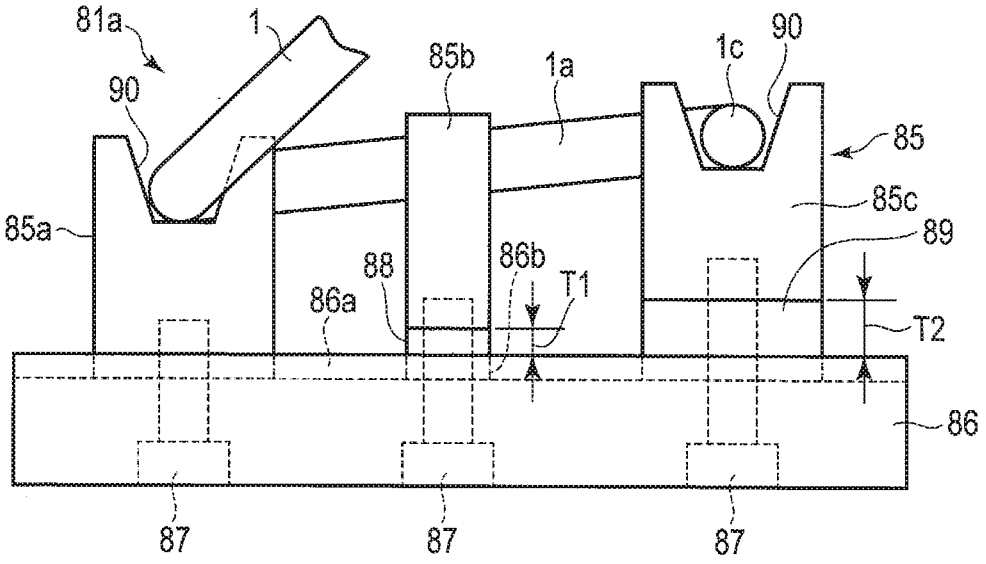
FIG. 11 is a front view of the lower side holder of the shot peening device of FIG. 7 and an end turn portion of the coil spring.

A shifting prevention jig 85 is provided with each of the lower side holder 81*a* of the first holding mechanism 81 and the lower side holder 82*a* of the second holding mechanism 82. A lower end turn portion 1*a* of the coil spring 1 can engage the shifting prevention jig 85. FIGS. 10 and 11 show the lower side holder 81*a* of the first holding mechanism 81. The structure of the lower side holder 82*a* of the second holding mechanism 82 is similar to that of the lower side holder 81*a* of the first holding mechanism 81. Thus, the lower side holder 81*a* of the first holding mechanism 81 will be explained with reference to FIGS. 10 and 11.

As shown in FIGS. 10 and 11, the shifting prevention jig 85 is provided with the lower side holder 81*a*. The shifting prevention jig 85 includes a plurality of pawls (for example, three pawls) 85*a*, 85*b*, and 85*c*. The pawls 85*a*, 85*b*, and 85*c* are arranged to conform to the shape, pitch angle, and the like of the end turn portion 1*a* such that the end turn portion 1*a* of the coil spring 1 can be stably supported. For example, the pawls 85*a*, 85*b*, and 85*c* are disposed on the lower side holder 81*a* in its peripheral direction at regular intervals (for example, 90°). Note that the number of pawls of the lower shifting prevention jig 85 and the number of pawls of an upper shifting prevention jig 91 may be other than three. Furthermore, the pawls may be disposed at intervals at an angle other than 90°.

Guide grooves 86*a* and 86*b* are formed in a base member 86 of circular plate shape. The pawls 85*a*, 85*b*, and 85*c* are movable along the guide grooves 86*a* and 86*b*. The pawls 85*a*, 85*b*, and 85*c* are adjusted to a position corresponding to the end turn portion 1*a* and the pawls 85*a*, 85*b*, and 85*c* are fixed to the base member 86 by blots 87 (shown in FIG. 11). Height adjustment members 88 and 89 are provided between the base member 86 and the pawls 85*b* and 85*c*. The height adjustment members 88 and 89 have thicknesses T1 and T2 which correspond to the pitch angles of the end turn portions of the coil spring. Thus, even an end turn portion of negative pitch can be stably mounted on the pawls 85*a*, 85*b*, and 85*c*. The pawls 85*a*, 85*b*, and 85*c* each include a V-shaped groove 90 into which the end turn portion 1*a* is inserted.

With the upper side holders 81*b* and 82*b*, a shifting prevention jig 91 corresponding to the upper end turn portion 1*b* is provided. As in the lower shifting prevention jig 85, the upper shifting prevention jig 91 includes a plurality of pawls (for example, three pawls) conforming to the shape, pitch angle, and the like of the end turn portion 1*b*. The upper end turn portion 1*b* is held stably by the pawls. The upper shifting prevention jig 91 may be formed different from the lower shifting prevention jig 85 depending on the shape of the end turn portion 1*b*.

The revolution mechanism 80 (shown in FIG. 5) rotates the turntable 79 around the revolution axis X1. That is, the revolution mechanism 80 intermittently rotates the turntable 79, 180° at a time in either first direction R1 or second direction R2 (shown in FIG. 9). When the first holding mechanism 81 is positioned in the first chamber 61, the second holding mechanism 82 is positioned in the second chamber 62. When the second holding mechanism 82 is positioned in the first chamber 61, the first holding mechanism 81 is positioned in the second chamber 62.

Furthermore, the shot peening device 50 includes, as shown in FIG. 7, a pressure mechanism 93 which compresses the coil spring 1. The pressure mechanism 93 includes presser units 94 and 95 which move the upper side holders 81*b* and 82*b* vertically. The presser units 94 and 95 include, for example, ball screws and servo motors. The presser units 94 and 95 can change a compression load (stress) applied to the coil spring 1 depending on the vertical movement amount of the upper side holders 81*b* and 82*b*. The presser units 94 and 95 may use fluid pressure as the drive source thereof as in a hydraulic cylinder.

First and second presser units 94 and 95 include load cells 96 and 97, respectively. The load cells 96 and 97 are examples of load detectors. The load cells (load detectors) 96 and 97 detect a compression load applied to the coil spring 1 during the shot peening, and input an electrical signal related to the detected compression load to a controller 98.

The shot peening device 50 includes a rotation mechanism 100. The rotation mechanism 100 rotates the coil spring 1 around the rotation axes X2 and X3. The rotation axes X2 and X3 each extend in a vertical direction. The rotation mechanism 100 includes a lower rotator 101 and an upper rotator 102. The lower rotator 101 rotates the lower side holders 81*a* and 82*a* around the rotation axes X2 and X3. The upper rotator 102 rotates the upper side holders 81*b* and 82*b* around the rotation axes X2 and X3.

The lower rotator 101 and the upper rotator 102 each include a drive source of a timing belt and a servo motor. The controller 98 which controls the drive source rotates the lower rotator 101 and the upper rotator 102 in the same direction in synchronization at the same revolution rate. That is, the lower side holders 81*a* and 82*a* and the upper side holders 81*b* and 82*b* rotate in the same direction in synchronization at the same revolution rate. Furthermore, the lower side holders 81*a* and 82*a* and the upper side holders 81*b* and 82*b* can stop at predetermined first rotation stop positions on the basis of the data preliminarily input in the controller 98.

An information processor 110 such as a personal computer is connected to the controller 98. The information processor 110 includes an input device. Serial number and various data (data such as coil diameter, turn number, length, wire diameter, pitch angle of end turn portion, and the like) of coil spring can be input the information processor 110 through the input device. Note that the controller 98 may be incorporated in the information processor 110 such as a personal computer.

FIG. 9 is a horizontal cross-sectional view of the first projection unit 55 and the second projection unit 56, viewed from the above. The first projection unit 55 includes an impeller (wing wheel) 121 and a distributor 122. The impeller 121 is rotated by a motor 120. The distributor 122 supplies shots SH2 to the impeller 121. The second projection unit 56 includes an impeller 126 rotated by a motor 125 and a distributor 127 which supplies shots SH2 to the impeller 126.

The first projection unit 55 is supported by a guide member 130 extending vertically to be movable in the vertical direction. The guide member 130 is provided with the side part of the housing 51. The first projection unit 55 reciprocates by the first elevator mechanism 58 (shown in FIG. 8) from a neutral position N1 to go over an ascend position A1 and a descend position B1. The second projection unit 56 is supported by a guide member 131 extending vertically to be movable in the vertical direction. The guide member 131 is provided with the side part of the housing 51. The second projection unit 56 reciprocates by the second elevator mechanism 59 from neutral position N2 to go over an ascend position A2 and a descend position B2.

Figure 12:
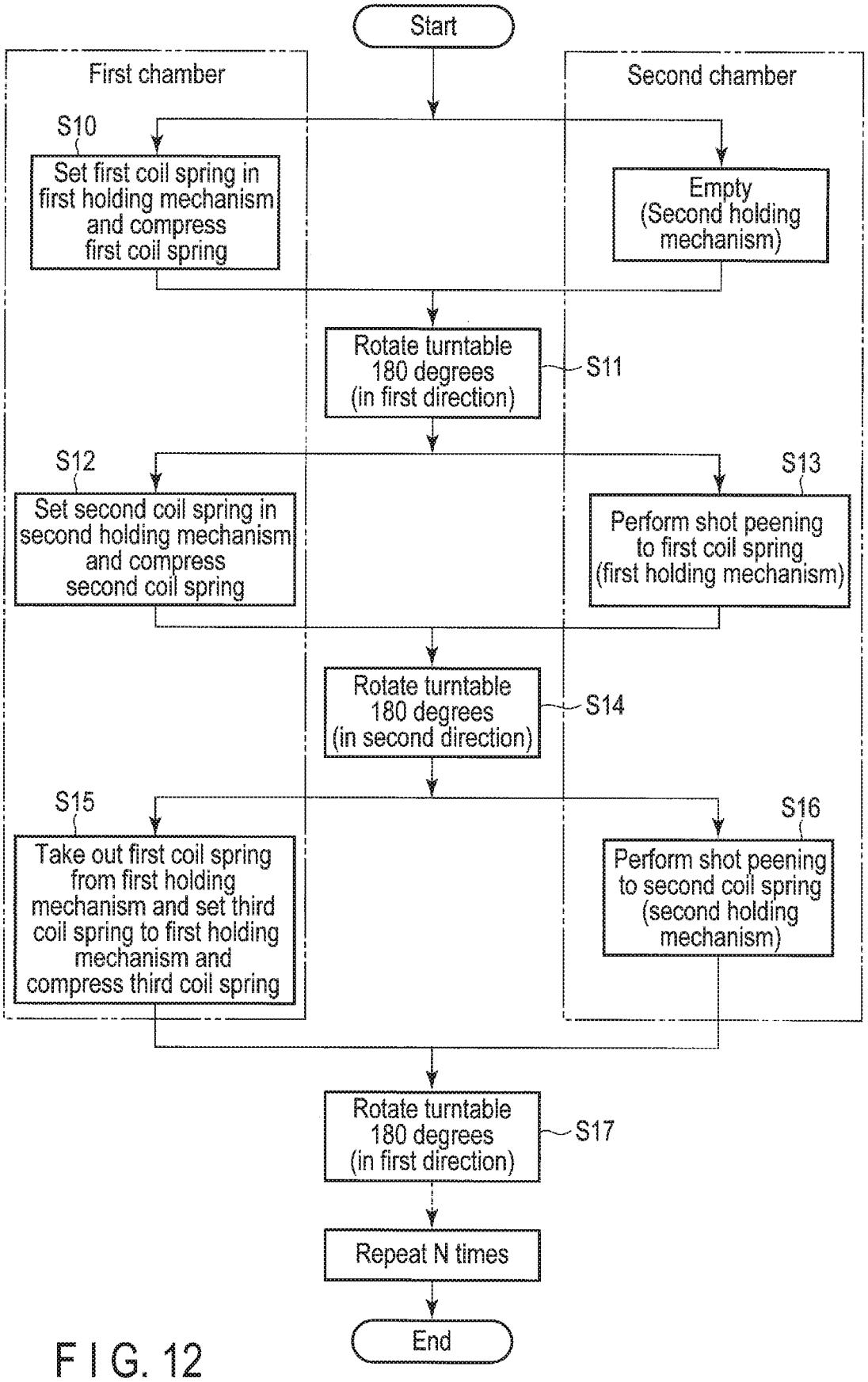
FIG. 12 is a flowchart of the operation of the shot peening device of FIG. 7.

FIG. 12 is a flowchart showing the operation of the shot peening device 50 of the present embodiment.

In step S10 of FIG. 12, the lower side holder 81*a* of the first holding mechanism 81 is stopped in the first chamber 61. First coil spring 1 is set to (mounted on) the lower side holder 81*a* by the robot 21 (shown in FIG. 4). The end turn portion 1*a* mounted on the lower side holder 81*a* is stopped by the shifting prevention jig 91 (shown in FIGS. 10 and 11). When the upper side holder 81*b* is lowered, the coil spring 1 is compressed between the lower side holder 81*a* and the upper side holder 81*b*. At that time, the second holding mechanism 82 is positioned in the second chamber 62. The second holding mechanism 82 is in an empty state where no coil spring is mounted thereon. The coil spring 1 in the left of FIG. 7 is in a free state where no compression load is applied thereto. The length of the coil spring 1 in the free state (free length) is L1. The coil spring 1 in the right of FIG. 7 is in a state where it is compressed to length L2.

In step S11 of FIG. 12, the turntable 79 rotates 180° in a first direction. By the rotation, the coil spring 1 held by the first holding mechanism 81 is sent to the second chamber 62. At the same time, the second holding mechanism 82 is moved to the first chamber 61. In step S12, second coil spring 1 is set to the second holding mechanism 82.

In step S13, in the second chamber 62, the first coil spring 1 in the compressed state is rotated (turns on its axis) by the rotation mechanism 100 and shot peening is performed. That is, the first projection unit 55 and the second projection unit 56 moving vertically project shots SH2 to the first coil spring 1. The shot peening is performed while the stress is applied to the coil spring 1, and thus, a compressive residual stress which is effective to increase the durability of the coil spring 1 can be produced in a surface portion of the coil spring 1.

In step S14, the turntable 79 rotates 180° in a second direction. Thus, the coil spring 1 held by the first holding mechanism 81 is returned to the first chamber 61. Furthermore, the coil spring 1 held by the second holding mechanism 82 is sent to the second chamber 62.

In step S15, the upper side holder 81*b* of the first holding mechanism 81 rises, and the first coil spring 1 held by the first holding mechanism 81 is taken by the robot 21. The first holding mechanism 81 becomes empty, and the robot 21 sets third coil spring 1 thereto. The upper side holder 81*b* descends to compress the coil spring 1.

In step S16, in the second chamber 62, the second coil spring 1 in the compressed state is rotated (turns on its axis) by the rotation mechanism 100 and shot peening is performed. That is, the first projection unit 55 and the second projection unit 56 moving vertically project shots SH2 to the second coil spring 1.

In step S17, the turntable 79 rotates 180° again in the first direction. Thus, the coil spring 1 held by the first holding mechanism 81 is sent to the second chamber 62 and the second holding mechanism 82 is returned to the first chamber 61. The upper side holder 82*b* of the second holding mechanism 82 rises, and then, the coil spring 1 held by the second holding mechanism 82 is taken by the robot 21. Next coil spring 1 is set by the robot 21 into the second holding mechanism 82 in the empty state. After that, the upper side holder 82*b* descends to compress the coil spring 1. A series of steps S10 to S17 is repeated by the number of coil springs 1 (N times), and the shot peening of all coil springs 1 is completed.

In the present embodiment, the position of end 1*c* of the coil spring 1 supplied to the shot peening device 50 is preliminarily restricted by the end positioning device 30. Thus, the position of end 1*c* of the coil spring 1 held by the robot 21 can be stored in a memory of the controller of the robot 21 or in a memory of the controller 98 of the shot peening device 50.

The coil spring 1 positioned as above is set to the first holding mechanism 81 or the second holding mechanism 82 by the robot 21. Before the coil spring 1 is set to the first holding mechanism 81 or the second holding mechanism 82, the first holding mechanism 81 or the second holding mechanism 82 is controlled by the controller 98 to stop at a first rotation stop position. The first rotation stop position is preliminarily set.

For example, the lower side holder 81*a* and the upper side holder 81*b* of the first holding mechanism 81 are stopped in the first rotation stop position in the first chamber 61 before the coil spring 1 is set by the robot 21. The lower side holder 82*a* and the upper side holder 82*b* of the second holding mechanism 82 are stopped in the first rotation stop position in the first chamber 61 before the coil spring 1 is set by the robot 21.

Now, a case where the first holding mechanism 81 is positioned in the first chamber 61 is considered. Therein, the robot 21 moves the chuck 23 along a movement path which is preliminarily programmed such that the end turn portion 1*a* is mounted on the lower side holder 81*a*. Then, the end turn portion 1*a* is inserted into the shifting prevention jig 85 of the first holding mechanism 81. When the second holding mechanism 82 is positioned in the first chamber 61, the robot 21 moves the chuck 23 along a movement path which is preliminarily programmed such that the end turn portion 1*a* is mounted on the lower side holder 82*a*. Then, the end turn portion 1*a* is inserted into the shifting prevention jig 85 of the second holding mechanism 82.

Therefore, a coil spring with end turn portions of positive pitch and a coil spring with end turn portions of unique shape such as negative pitch can be securely set to the first holding mechanism 81 or the second holding mechanism 82. The end turn portion of positive pitch has a pitch angle of positive value. The end turn portion of negative pitch has a pitch angle of negative value.

When the coil spring 1 after the shot peening is taken from the first chamber 61, the rotation mechanism 100 is controlled by the controller 98 such that the first holding mechanism 81 or the second holding mechanism 82 is stopped in a second rotation stop position. Thus, when the coil spring 1 after the shot peening is taken from the first chamber 61, the robot 21 can memorize the position of ends 1*c* and 1*d* of the coil spring 1. That is, when the coil spring 1 is transferred to the conveyor device which sends the coil spring 1 to the next step, the robot 21 can handle the coil spring 1 to the conveyor device while the position of end 1*c* of the coil spring 1 is determined.

Figure 13:
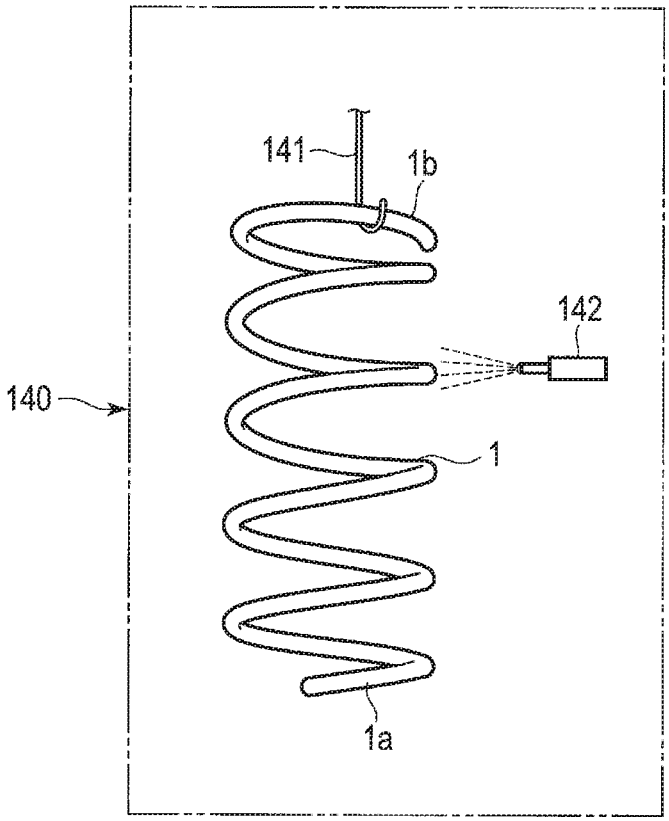
FIG. 13 is a front view showing a hanger hanging a coil spring and a part of a coating device.

FIG. 13 shows that the coil spring 1 after the shot peening is hung by a hanger 141. The coil spring 1 hung by the hanger 141 is sent to a coating booth 140, for example. The robot 21 can hook the end 1*c* of the coil spring 1 onto the hanger 141 while the position of the end 1*c* hooked to the hanger 141 is limited to a certain acceptable range. The coil spring 1 set to the coating booth 140 is coated by a spray gun 142. The coated coil spring 1 is heated in a heating chamber, and the coating is fixed on the coil spring 1. The first rotation stop position and the second rotation stop position may be the same depending on types of the conveyor device or the like. Or, the first rotation stop position and the second rotation stop position may be different.

In exercising the present invention, models, structures, and arrangement of the elements of the first shot peening device and the second shot peening device can be arbitrarily changed. That is, specific shapes and structures of the end positioning device, transfer mechanism (robot), conveyor device (conveyor), and the like can be arbitrarily changed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A coil spring processing system comprising:

an end positioning device which restricts ends of a coil spring to certain positions of a coil periphery and holds the coil spring; and a shot peening device which performs shot peening while the coil spring is kept standing, wherein the shot peening device comprises:

a turntable mechanism including a turntable;

a revolution mechanism which rotates the turntable mechanism around a revolution axis;

a holding mechanism including a lower shifting prevention jig which holds a lower end turn portion of the coil spring and an upper shifting prevention jig which holds an upper end turn portion of the coil spring, the holding mechanism being configured to rotate around the revolution axis with the turntable;

a rotation mechanism which rotates the holding mechanism around a rotation axis;

a controller which stops the holding mechanism at a rotation stop position corresponding to the end turn portions of the coil spring;

a transfer mechanism which sets the coil spring, the ends of which are restricted by the end positioning device, to the holding mechanism stopped in the rotation stop position;

a pressure mechanism which compresses the coil spring while the coil spring is set to the holding mechanism; and a projection mechanism which projects shots to the compressed coil spring, and wherein the end positioning device comprises:

a base;

a supporting member fixed to the base and supporting one end turn portion of the coil spring to rotate around an axis of the coil spring;

a stopper provided with the supporting member and which one end of the coil spring contacts while the coil spring reaches a certain position around the axis;

a rotation member opposed to the supporting member and movable in a direction closing to and a direction apart from the supporting member while the other end turn portion of the coil spring is supported; and an engaging portion provided with the rotation member and which the other end of the coil spring contacts.

2. The coil spring processing system of claim 1, wherein the shot peening device includes a first chamber and a second chamber, the revolution mechanism rotates the turntable around the revolution axis 180° at a time, and the holding mechanism reciprocates over the first chamber and the second chamber by the revolution mechanism.

3. The coil spring processing system of claim 1, wherein the lower shifting prevention jig includes a plurality of pawls supporting the lower end turn portion of the coil spring at plurality of positions where the pawls have different heights corresponding to a pitch angle of the end turn portion.

4. The coil spring processing system of claim 1, wherein the controller stops the holding mechanism in a first rotation stop position in a state where the coil spring is before being set to the holding mechanism and stops the holding mechanism in a second rotation stop position in a state where the coil spring held by the holding mechanism is before being taken from the holding mechanism.

5. The coil spring processing system of claim 4, wherein the first rotation stop position and the second rotation stop position differ from each other.

6. The coil spring processing system of claim 4, wherein the first rotation stop position and the second rotation stop position are the same.

* * * * *